US009618255B2

(12) United States Patent
Lühr

(10) Patent No.: US 9,618,255 B2
(45) Date of Patent: Apr. 11, 2017

(54) PERSONAL SAFETY SYSTEM AND PROCESS FOR THE OPERATION OF A PERSONAL SAFETY SYSTEM

(71) Applicant: Dräger Safety AG & Co. KGaA, Lübeck (DE)

(72) Inventor: Matthias Lühr, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 298 days.

(21) Appl. No.: 14/045,896

(22) Filed: Oct. 4, 2013

(65) Prior Publication Data

US 2014/0096541 A1 Apr. 10, 2014

(30) Foreign Application Priority Data

Oct. 6, 2012 (DE) ..... 10 2012 019 699

(51) Int. Cl.
*F25D 13/00* (2006.01)
*E21F 11/00* (2006.01)
*F25D 3/10* (2006.01)

(52) U.S. Cl.
CPC ..... *F25D 13/00* (2013.01); *E21F 11/00* (2013.01); *F25D 3/10* (2013.01)

(58) Field of Classification Search
CPC .. F25D 13/00; F25D 3/10; E21F 11/00; E21F 3/00
See application file for complete search history.

(56) References Cited

U.S. PATENT DOCUMENTS 2,450,338 A * 9/1948 Heidbrink ..... F16K 3/08 128/205.28
5,762,266 A * 6/1998 Okumura ..... B60H 1/00328 237/12.3 A
8,007,047 B2 8/2011 Kennedy et al.
2002/0192013 A1* 12/2002 Ou ..... B25J 15/04 403/68
2004/0074548 A1* 4/2004 Acree ..... B60P 7/0846 137/899.4
2007/0202796 A1 8/2007 Kennedy et al.
(Continued)

FOREIGN PATENT DOCUMENTS

CN 102011608 A 4/2011
CN 102011608 A * 4/2011
(Continued)

OTHER PUBLICATIONS

Australian Office Action of Apr. 21, 2015.
Chinese Search Report of Nov. 12, 2015 in English.

*Primary Examiner* — Emmanuel Duke
(74) *Attorney, Agent, or Firm* — McGlew and Tuttle, P.C.

(57) ABSTRACT

A personal safety system in the form of a refuge chamber includes at least one main room and a cooling device provided for cooling the ambient air of the main room in the form of a $CO_2$ cooling system (10). The $CO_2$ cooling system (10) has a heat exchanger (28) and a first and a second pressure reducer (20, 32) upstream and downstream of heat exchanger (28), respectively. The heat exchanger (28) has a plurality of alternatingly or cyclically usable cooling coils. A process is provided for the operation of such a refuge chamber.

20 Claims, 3 Drawing Sheets

(56) References Cited

U.S. PATENT DOCUMENTS

| | | | | |
|---|---|---|---|---|
| 2010/0018391 | A1* | 1/2010 | Whittaker | B01D 53/62 95/23 |
| 2010/0071393 | A1* | 3/2010 | Tatton | E21F 11/00 62/121 |
| 2012/0233923 | A1* | 9/2012 | Diercks | E04H 9/04 49/70 |

FOREIGN PATENT DOCUMENTS

| | | | | |
|---|---|---|---|---|
| CN | 102022136 | A | | 4/2011 |
| CN | 201 857 993 | U | | 6/2011 |
| CN | 102108876 | A | | 6/2011 |
| CN | 201865689 | U | | 6/2011 |
| CN | 102135008 | A | | 7/2011 |
| CN | 102135008 | A | * | 7/2011 |
| CN | 102392673 | A | * | 3/2012 |
| CN | 102392673 | A | | 3/2012 |
| CN | 202228112 | U | | 5/2012 |
| CN | 102562134 | A | | 7/2012 |
| CN | 102926798 | A | * | 2/2013 |
| DE | 10 2011 014 104 | B3 | | 6/2012 |

* cited by examiner

PERSONAL SAFETY SYSTEM AND PROCESS FOR THE OPERATION OF A PERSONAL SAFETY SYSTEM

CROSS REFERENCE TO RELATED APPLICATIONS

This application claims the benefit of priority under 35 U.S.C. §119 of German Patent Application DE 10 2012 019 699.7 filed Oct. 6, 2012, the entire contents of which are incorporated herein by reference.

FIELD OF THE INVENTION

The present invention pertains to a personal safety system in the form or in the style of a so-called refuge chamber or a safety room, as it can be used for personal safety, for example, in mining, and especially in potentially explosive areas, i.e., for example, in coal mining. Furthermore, the present invention also pertains to a process for the operation of a personal safety system.

BACKGROUND OF THE INVENTION

For such refuge chambers/safety rooms, it is known that they need a cooling system if people stay in the interior thereof. An air conditioning system, or the like, is considered for the cooling system. However, only an operation of special, so-called explosion-proof air conditioning systems is permissible in potentially explosive areas. Usually, electrical air conditioning systems are ruled out for such a use because electrical discharges or electrical arcings may ignite ignitable mixtures (for example, methane, coal dust, etc.) and trigger explosions.

A refuge chamber with a means for cooling and dehumidifying the interior of the refuge chamber has become known from CN 201 857 993 U. The achieving of the cooling action is based here on the use of compressed liquid carbon dioxide ($CO_2$). The liquid carbon dioxide is provided in the compressed form in containers provided for this and is supplied via a pressure reducer, on the one hand, to a vortex tube for cooling and, on the other hand, to a pneumatic motor for driving a fan. In addition, the ambient heat taken up during the driving of the pneumatic motor with carbon dioxide as well as an air stream generated with a drive of a fan by the pneumatic motor shall be used for cooling the interior of the refuge chamber as well. The pneumatic motor is combined with, among other things, a radiator into an air dehumidifying and air purifying unit. Corresponding chemicals, which are placed in the air stream arising because of the fan by means of the air dehumidifying and air purifying unit, are provided for absorbing carbon dioxide ($CO_2$) and carbon monoxide (CO) in the ambient air in the interior of the refuge chamber.

A refuge chamber for use in mining, comprising a cooling means, which can be put into operation only at a methane concentration below a predetermined level within the refuge chamber, is known in U.S. Pat. No. 8,007,047 B2.

A personal safety system in the form of a refuge chamber with a security entrance, a holding room connected to the security entrance and with an air curtain device on the entrance door of the security entrance, is known from the not previously published DE 10 2011 014 104 of Mar. 28, 2011. So that persons can reach the holding room in a short time, a circulating air system is provided for the interior of the refuge chamber. Besides the holding room, the interior includes the security entrance as well. The circulating air system comprises an air feed means and a toxic gas filter, an air flushing means comprising air cells for the holding room as well as a gas supply duct for respirator products in the holding room.

SUMMARY OF THE INVENTION

Based on this state of the art, an object of the present invention is to provide a further embodiment of a personal safety system of the type mentioned in the introduction that is suitable for potentially explosive areas and can thereby be operated in a simple manner and without problems.

This object is accomplished according to the present invention with a device designated here and below as a personal safety system in the form or the style of a so-called refuge chamber or safety room, as it is used for personal safety, for example, in mining, especially in potentially explosive areas. For this, in a personal safety system in the form of a refuge chamber with at least one main room and a cooling means provided for cooling the ambient air of the main room, provisions are made for a carbon dioxide cooling system, designated below sometimes also only in short as $CO_2$ cooling system, to function as cooling means, which is based on the principle of boiling cooling and which performs the cooling therefore by way of a change in state of the carbon dioxide from liquid to gaseous, whereby the $CO_2$ cooling system comprises a carbon dioxide reservoir ($CO_2$ reservoir) and a heat exchanger and whereby the $CO_2$ cooling system has at least one first pressure reducer between the $CO_2$ reservoir and the heat exchanger as well as at least one second pressure reducer in connection with the heat exchanger.

The advantage of the present invention lies in the fact that with the at least one first pressure reducer and the at least one second pressure reducer, the drop in pressure of the at first liquid carbon dioxide takes place in at least two separate steps, for example, from 200 bar as the pressure, under which the carbon dioxide is in the steel cylinders provided for the storage thereof, to at first 10 bar in the feed line to the heat exchanger and finally to 2 bar to 6 bar in connection with the output of the heat exchanger. By means of the at least two-step drop in pressure of the carbon dioxide, an otherwise freezing solid of the pipelines, in which the carbon dioxide flows, which may have to be dealt with, is prevented. This increases the availability and operating safety of the refuge chamber functioning as a personal safety system. Another advantage lies in the fact that in connection with the second pressure reducer such a pressure is reached, which makes possible the problem-free connection of other units, such as, for example, a pneumatic motor, without there being a risk that such a unit freezes solid and thus malfunctions or is even damaged and thus is not or at least not immediately again available for work even after thawing. This also increases the availability and operating safety of the refuge chamber because the availability of a pneumatic motor, which is usually guaranteed in this manner, results in a correspondingly guaranteed availability of a pneumatic blower with such a pneumatic motor and the pneumatic blower in turn is active for receiving a favorable air distribution and thus an efficient, comprehensive cooling, but is active for the continuous supply of ambient air to the heat exchanger as well, whereby the latter likewise helps prevent a freezing up of the heat exchanger or to at least markedly lower a risk in this respect.

In a special, optionally also alternative embodiment of the personal safety system, a heat exchanger is provided with a plurality of alternatingly or cyclically usable cooling coils.

Two or more cooling coils are then alternatingly or cyclically usable and, for example, with two cooling coils, one of the two coils is used for cooling the ambient air in the refuge chamber, while the other cooling coil can thaw. This guarantees a high availability of the $CO_2$ cooling system. In addition, in a heat exchanger with two or more cooling coils, one of the cooling coils functions as a primary cooling coil and the second and any other cooling coil functions as a redundant cooling coil, over to which it is possible to switch in case of a failure of the primary cooling coil. Consequently, the $CO_2$ cooling system is fail-safe, whereby the fail-safeness increases further in case of more than two cooling coils and, in addition, the alternating/cyclical usability of the individual cooling coils is still retained.

The embodiment of the personal safety system with a heat exchanger with at least two cooling coils is considered as an alternative or in addition to an embodiment of the personal safety system with two pressure reducers, such that the embodiment with a heat exchanger with at least two cooling coils optionally also achieves independent inventive quality.

In a further embodiment of the personal safety system, a pneumatic blower driven from the $CO_2$ reservoir in connection with the heat exchanger is provided. The pneumatic blower comprises a pneumatic motor driven by the $CO_2$ stream and a fan driven by the pneumatic motor. The pneumatic blower can thus run without an electric line and is therefore especially suitable for use in potentially explosive areas like the personal safety system described here. With regard to the $CO_2$ stream, the pneumatic blower is arranged in connection with the heat exchanger, such that with the fan driven by the pneumatic motor in the area of the heat exchanger, an air stream is generated that discharges the cold forming at the heat exchanger, by ambient air being continuously fed to the heat exchanger. This brings about, on the one hand, a good mixing of ambient air and thus the intentional cooling of the interior space of the refuge chamber and prevents, on the other hand, a freezing up of the heat exchanger because of the supply of warmer ambient air to the heat exchanger.

The above-mentioned object is also accomplished with a process for the operation of a personal safety system as described here and below. For this, provisions are made in the operating process that a pressure pending in a main pipe arising from a pressure, with which the carbon dioxide is fed, is lowered with the at least one first pressure reducer to an operating pressure for the heat exchanger and that a prevailing pressure in connection with the heat exchanger is lowered further with the at least one second pressure reducer before the carbon dioxide is fed to the pneumatic blower.

A further or even alternative embodiment of a process for the operation of a personal safety system as described here and below is characterized in that a plurality of cooling coils comprised by the heat exchanger is alternatingly or cyclically switched over, such that a freezing up of a cooling coil is prevented by one of the at least two cooling coils being used for cooling, while the or any other cooling coil can thaw.

In a process for the operation of a personal safety system comprising a pneumatic blower, ambient air cooled by the heat exchanger is distributed into the main room of the refuge chamber with a fan comprised by the pneumatic blower. This air distribution brings about, on the one hand, a good air mixing in the main room and thus intentional cooling and, on the other hand, a supply of ambient air to the heat exchanger, as a result of which the risk of freezing up of the heat exchanger, and in particular of the respective, operating cooling coil, is reduced.

Even though the present invention was described up to now as a personal safety system with a $CO_2$ cooling system, the present invention also pertains to a $CO_2$ cooling system as described here and below as a unit that is independent and suitable for use in a personal safety system provided as a refuge chamber, as well as a process for the operation of such a $CO_2$ cooling system.

An exemplary embodiment of the present invention is described in detail below on the basis of the drawing. Objects or components corresponding to one another are provided with the same reference numbers in all figures.

The exemplary embodiment or each exemplary embodiment is not to be defined as a limitation of the present invention. Rather, changes and modifications are possible within the framework of the present disclosure, especially such variants and combinations, which can be derived for the person skilled in the art with regard to accomplishing the object, for example, by combining or modifying individual features or components or process steps described in conjunction with the general or special section of the specification as well as contained in the claims and/or drawing and lead, by means of combinable features, to a novel subject or novel process steps or process step sequences, even if they pertain to testing methods and working methods. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
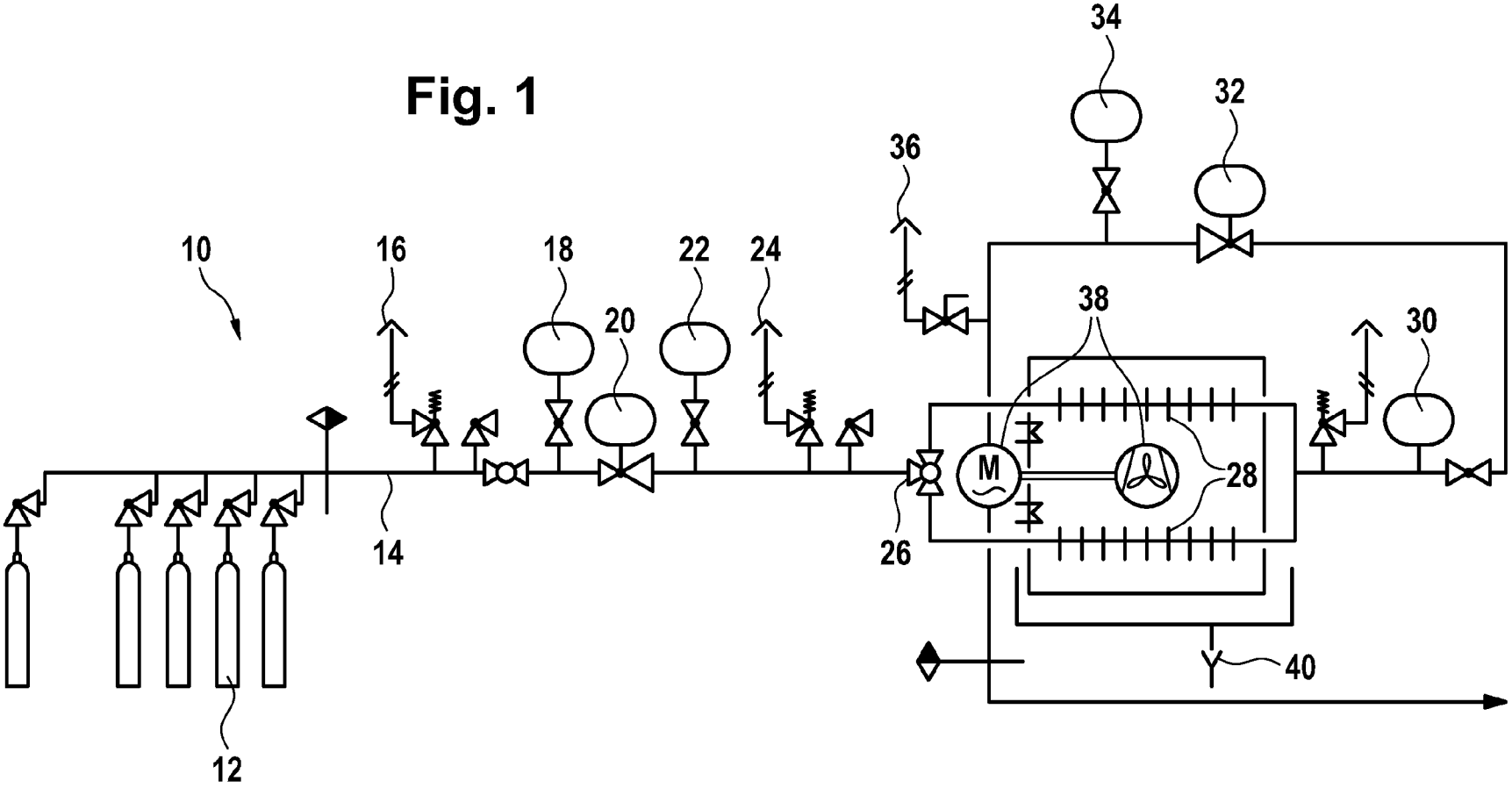
FIG. 1 is a schematic view of a $CO_2$ cooling system for use in a personal safety system.

Referring to the drawings in particular, FIG. 1 shows in a schematically simplified schematic view a carbon dioxide cooling system also designated below in short as $CO_2$ cooling system 10 for use in a personal safety system of the type mentioned in the introduction. This carbon dioxide cooling system 10 comprises, for example, one or more steel cylinders 12 each filled with liquid carbon dioxide as storage containers for liquid carbon dioxide and thus as $CO_2$ reservoir. These steel cylinders 12 are connected via a main line 14 to a first safety valve 16, a first pressure indicator 18, a first pressure reducer 20, another pressure indicator 22, a second safety valve 24 and a three-way valve 26 at a heat exchanger 28, downstream of which are arranged a consumption indicator 30, another pressure reducer 32, a drain valve 34 and a third safety valve 36 on the output side.

A switching over between at least a first and a second cooling coil comprised by the heat exchanger 28 is possible with a switching over means comprising the three-way valve 26. The three-way valve 26 can be operated either manually or automatically and makes possible a switching over between the at least two cooling coils in order to make possible a thawing of a respective, unused cooling coil. This makes the $CO_2$ cooling system 10 overall fail-safe to a great extent, because due to the possibility of thawing an unused cooling coil, there is always the possibility of switching over to a usable cooling coil in order to thus obtain a sufficient cooling capacity. With two cooling coils, an alternating use of cooling coils is thus possible, whereby the respective, unused cooling coil is thawed. In case of more than two cooling coils, a cyclical use of the cooling coils is possible, whereby the respective, unused cooling coils or the last used cooling coil are thawed or is thawed, respectively.

A pneumatic blower 38 with a pneumatic motor with a fan driven thereby is associated with the heat exchanger 28 with the at least two cooling coils. The use of a pneumatic motor has the advantage of its problem-free usability in a potentially explosive area. The fan driven by the pneumatic motor makes possible a uniform and rapid distribution of cooled ambient air in the interior of the personal safety system and a supply of ambient air to the heat exchanger 28.

The use of at least two pressure reducers 20, 32, in particular, a first pressure reducer 20 in the main line from the steel cylinders 12 to the heat exchanger 28 here, i.e., on the high pressure side, and a second pressure reducer 32 in connection with the heat exchanger 28, i.e., on the low pressure side, makes possible a gradual drop in pressure of the liquid carbon dioxide, in particular, for example, from 200 bar initially to 10 bar (first pressure reducer 20) and then to 2 bar to 6 bar (second pressure reducer 32). Such a gradual drop in pressure effectively prevents the freezing solid of the pipelines and thus guarantees the availability of the $CO_2$ cooling system 10.

A drainage device 40, by means of which water of condensation, which is collected in a collecting tray or the like provided for this purpose, can be drained and disposed of in a suitable manner, is shown below the heat exchanger 28.

Figure 2:
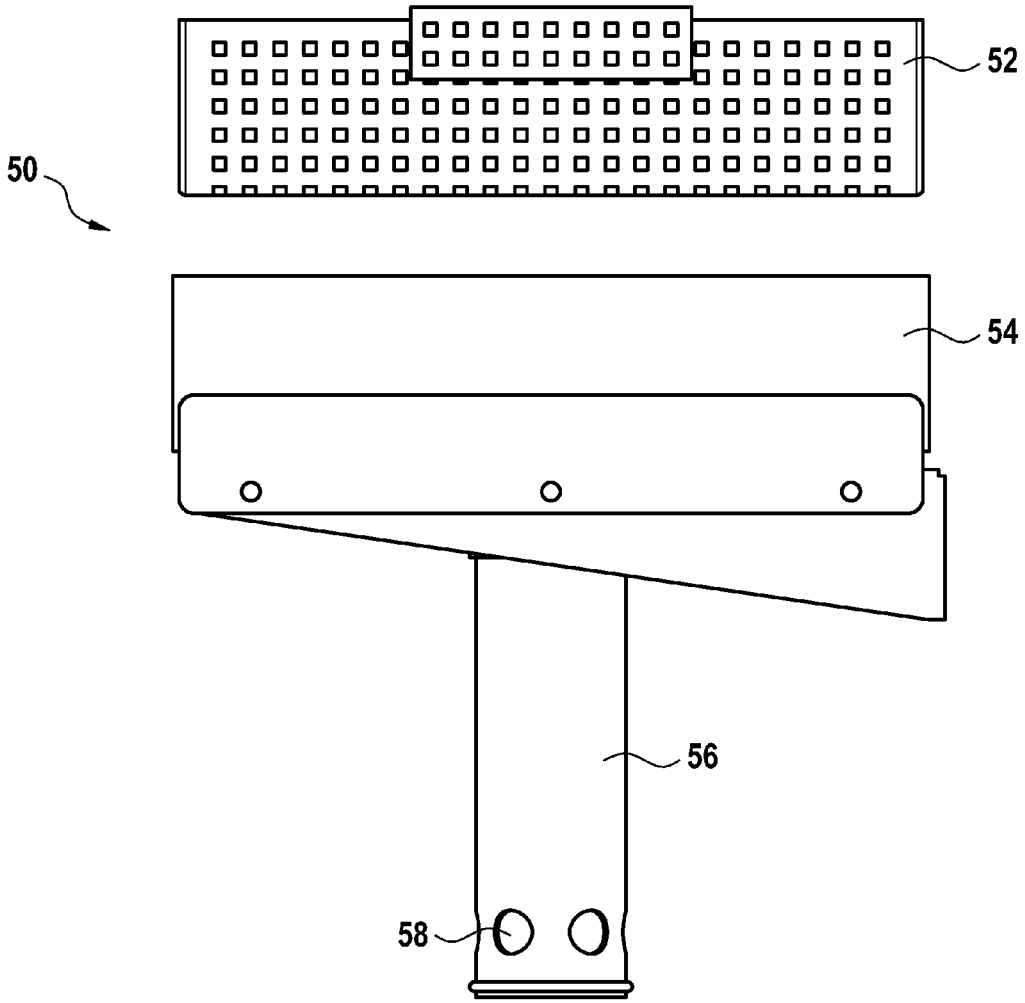
FIG. 2 is a schematic view of a $CO_2$ absorber in the form of a $CO_2$ bed absorber for use in a personal safety system.

FIG. 2 shows a schematically simplified schematic view of a $CO_2$ bed absorber 50 functioning as a $CO_2$ absorber, which in the embodiment shown essentially comprises a basket 52 and a body 54. The $CO_2$ absorber shall prevent a $CO_2$ concentration from rising above a permissible mass in the ambient air, by gaseous carbon dioxide being bound by soda lime located in the absorber.

The body 54 of the $CO_2$ bed absorber 50 is attached to a connection pipe 56, in whose foot air inlets 58, especially sealable air inlets 58, in the form of borings or the like are formed. Soda lime is filled into the basket 52, and the basket 52 is hung in the body 54. The connection pipe 56 is connected by means of a tube or hose connection, for example, to the incoming air stream of a heat exchanger 28 (FIG. 1) of the $CO_2$ cooling system 10 (FIG. 1). Thus, ambient air is drawn in through the soda lime bed formed in the basket 52 and bound to $CO_2$ present there. When the soda lime has lost its bindability, the spent soda lime is disposed of by simply pouring into a residue container, not shown here. The basket 52 is then inserted into the body 54 again and filled with new soda lime or is filled with new soda lime before inserting into the body 54.

The quantity of incoming air drawn in by means of the soda lime bed to the heat exchanger 28 can be regulated with sealable air inlets 58. A sealability of the air inlets 58 can be achieved for example by a rotatable sleeve, mounted concentrically to the connection pipe 56, with borings corresponding to the air inlets 58 being arranged in the connection pipe 56 or outside the connection pipe 56 (not shown). By means of a rotation of the sleeve, the air inlets 58 in the connection pipe 56 and borings in the sleeve can be synchronized, such that secondary air can be drawn into the connection pipe 56. This reduces the quantity of incoming air drawn in by the soda lime bed to the heat exchanger 28. When the air inlets 58 in the connection pipe 56 are entirely or partly closed by means of a rotation of the sleeve, the quantity of the incoming air drawn in by the soda lime bed increases. Instead of a rotatable sleeve, a displaceable sleeve may also be considered. Borings in the sleeve may be omitted here, and the extent, to which the air inlets 58 in the connection pipe 56 are opened or closed, arises due to the translatory position of such a sleeve.

Figure 3:
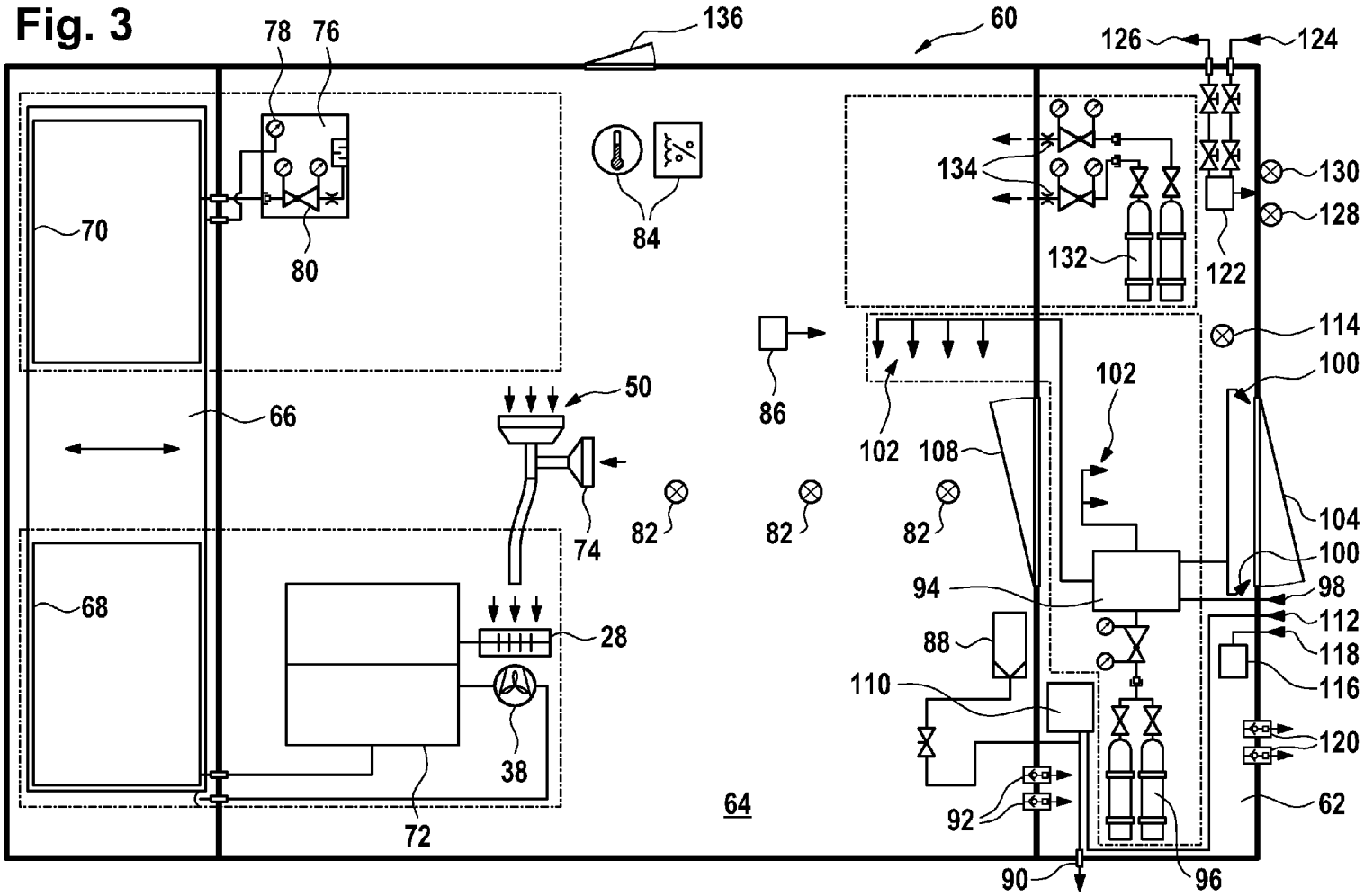
FIG. 3 is a general view of a refuge chamber functioning as a personal safety system with a $CO_2$ cooling system according to FIG. 1 as well as a $CO_2$ bed absorber according to FIG. 2.

FIG. 3 shows a personal safety system in the form of a refuge chamber 60 designated overall with the reference number 60. This [refuge chamber] comprises in a manner known per se an air lock 62, a main room 64 and an engineering room 66. The engineering room 66 is divided into a first storage area 68 and a second storage area 70. Steel cylinders 12 (FIG. 1) containing liquid carbon dioxide, for example, 12 cylinders containing 40 L of liquid carbon dioxide each at a pressure of 200 bar, for a $CO_2$ cooling system 10, and especially a $CO_2$ cooling system 10 of the type shown in FIG. 1, are found in the first storage area 68. The first storage area 68 and the steel cylinders 12 provided there can accordingly be regarded individually or together as a $CO_2$ reservoir. Containers containing breathing air, for example, 10 steel cylinders each containing 50 L of breathing air at a pressure of likewise 200 bar, are found in the second storage area 70, functioning as a breathing air storage unit. A cylinder carriage, indicated here only by the double arrow, is optionally found in the engineering room 66 for the facilitated handling of the steel cylinders.

The liquid carbon dioxide stored in engineering room 66 is, on the one hand, fed to heat exchanger 28 and, on the other hand, to the pneumatic blower 38. A control panel 72 here makes possible an operation of heat exchanger 28 and/or pneumatic blower 38. The control panel 72 can be designed here—as shown—in two parts or in the form of two individual control panel components, such that a first part or a first section or a first control panel component is reserved for the operation and/or observation of the heat exchanger 28 and a second part/second section or a second control panel component is reserved for operation and/or observation of pneumatic blower 38. The components of the $CO_2$ cooling system 10 shown in FIG. 1, in particular, first safety valve 16, pressure indicator 18, first pressure reducer 20, pressure indicator 22, second safety valve 24, three-way valve 26, consumption indicator 30, second pressure reducer 32 and third safety valve 36 may be associated with the control panel 72 as well for this, such that, in a collective manner, on the one hand, an overview of the status of the $CO_2$ cooling system 10 and/or of the heat exchanger 28 as well as, on the other hand, a possibility of operating the $CO_2$ cooling system 10 and/or the heat exchanger 28 is given.

In the embodiment shown, a $CO_2$ absorber 50, for example, a $CO_2$ absorber 50 according to FIG. 2, is disposed in the refuge chamber 60. The connection pipe 56 thereof (FIG. 2) is extended in the direction of the heat exchanger 28, such that incoming air is drawn in by the $CO_2$ absorber 50 for the heat exchanger 28. In the embodiment shown, a $CO_2$ filter is also associated with $CO_2$ absorber 50.

The fact that $CO_2$ absorber 50 is connected via a ground clip or the like to the housing of the refuge chamber 60, in particular, for example, to the floor of the main room 64 and is thus grounded, is not shown.

The breathing air provided in the second storage area 70 can be discharged by means of operating actions at a control panel, designated as air control panel 76 for differentiation, in the main room 64 of the refuge chamber. The air control panel 76 comprises for this, on the one hand, a room pressure gauge 78 and, on the other hand, a room air valve 80 for adjusting the breathing air drawn from the breathing air storage area 70.

Further shown details in refuge chamber 60 are a main room lighting 82 with lighting means in the form of glow sticks or the like, means 84 for measuring temperature and/or humidity, a gas meter 86 for measuring the concentrations of one or more gases, such as, for example, $CH_4$, CO, $CO_2$, $O_2$, in the interior of the main room 64.

In addition, a dehumidifier 88 with a dehumidifier outlet 90 routed into the air lock 62, means for pressure compensation between air lock 62 and main room 64 in the form of at least one pressure compensation valve 92, as well as means for air lock flushing with a flushing unit 94, a reservoir 96 for the gas provided for the air lock flushing and gas outlets 100, 102, 104 in air lock area 62 and in the main room 64 are shown for the refuge chamber 60 shown in FIG. 3. The flushing unit 94 is supplied here with a corresponding gas from the reservoir 96, but is connected by an external air connection 98 also to the ambient air outside the refuge chamber 60.

The gas outlets 100, 102 in air lock area 62 function, on the one hand, as an air curtain for an outer door 106 of the refuge chamber 60 and, on the other hand, for air flushing in the air lock area. The gas outlets 104 in the main room 64 are used for flushing any contaminants from the main room 64 still having entered same after leaving the air lock 62 and passing through an inner door 108 between air lock 64 [sic, 62—Tr.Ed.] and main room 64. The outer door 106 and the inner door 108 make possible an access to the refuge chamber 60, in particular, at first via the outer door 106 into the air lock 62 and then via the inner door 108 from the air lock 62 into the main room 64.

Furthermore, a plumbing unit 110 with an external water connection 112 and, for example, a port-a-potty, an air lock lighting 114, a telephone 116 with an external telephone connection 118 and one or more overpressure valves 120 are found in the air lock area 62. Finally, another gas meter 122 is also provided in the air lock for measuring a concentration of one or more gases, for example, $CH_4$, CO, $CO_2$, $O_2$ outside the refuge chamber 60 and for this the gas meter 122 is coupled via an air inlet 124 and an air outlet 126 to the ambient air outside the refuge chamber 60. Moreover, two signaling or lighting means 128, 130 are shown, which, for example, in the form of a flashlight or in the form of a lighting station with glow sticks, make it easier to find refuge chamber 60 or indicate a status of refuge chamber 60.

Besides the breathing air which can be fed into the main room 64 from the second storage area 70, which may also be considered to be emergency breathing air supply, steel cylinders 132 for oxygen supply of the main room 64, functioning as main breathing air supply, with corresponding oxygen outlets 134 are shown in FIG. 3 in the area of air lock 62. The arrangement of one or more steel cylinders 132 or the like in air lock 62 or in the engineering room 66 for feeding the main breathing air supply and/or emergency breathing air supply may depend on the respective conditions on site and such steel cylinders 132 may accordingly be arranged either in the area of the air lock 62 or in the engineering room 66 or in the area of the air lock 62 and in the engineering room 66. An escape hatch 136 is provided for leaving the main room 64 in an emergency or the like.

Some aspects of the specification submitted here having priority can thus be summarized briefly as follows: a personal safety system is provided in the form of a refuge chamber 60 with at least one main room 64 and a cooling means in the form of a $CO_2$ cooling system 10 provided for cooling the ambient air of the main room 64, whereby the $CO_2$ cooling system 10 has a heat exchanger 28 and a first and a second pressure reducer 20, 32 upstream and downstream of the heat exchanger 28, respectively, and/or a heat exchanger 28 with a plurality of alternatingly or cyclically usable cooling coils. Furthermore, a process is indicated for the operation of such a refuge chamber 60 and here in particular the use of at least two pressure reducers 20, 32 for the gradual drop in pressure of the carbon dioxide, which is at first in the liquid form (at high pressure), and the use of at least two cooling coils.

While specific embodiments of the invention have been shown and described in detail to illustrate the application of the principles of the invention, it will be understood that the invention may be embodied otherwise without departing from such principles.

What is claimed is:

1. A personal safety system in the form of a refuge chamber, the personal safety system comprising:

a main room;

a cooling means for cooling ambient air of the main room, the cooling means comprising a $CO_2$ cooling system comprising a $CO_2$ reservoir, a heat exchanger, a first pressure reducer between the $CO_2$ reservoir and the heat exchanger and a second pressure reducer in connection with the heat exchanger, said first pressure reducer reducing a reservoir pressure of carbon dioxide to a heat exchanger operating pressure for said heat exchanger, said reservoir pressure of carbon dioxide being greater than said heat exchanger operating pressure, said first pressure reducer being arranged directly at an output of said $CO_2$ reservoir; and a pneumatic blower driven from the $CO_2$ reservoir, the pneumatic blower being located downstream of the heat exchanger, said second pressure reducer reducing the pressure of carbon dioxide to a pneumatic operating pressure for said pneumatic blower, said pneumatic operating pressure being less than said heat exchanger operating pressure, wherein said second pressure reducer reduces said pressure of carbon dioxide in a flow direction from said heat exchanger to said pneumatic blower, wherein a temperature of the carbon dioxide increases from the first pressure reducer to the second pressure reducer, said second pressure reducer being mounted directly at an input of said heat exchanger.

2. The personal safety system in accordance with claim 1, wherein the heat exchanger comprises a plurality of cooling coils, the cooling coils being alternatingly or cyclically operated cooling coils, said reservoir pressure being 200 bar, said heat exchanger operating pressure being 10 bar, said pneumatic operating pressure being 2 bar to 6 bar, wherein said temperature of said carbon dioxide increases from said first pressure reducer to said second pressure reducer exclusively via a heat exchange between said carbon dioxide and said ambient air.

3. The personal safety system in accordance with claim 2, wherein the cooling system further comprises switching over means for switching over between the cooling coils in order to make possible a thawing of a respective unused cooling coil.

4. The personal safety system in accordance with claim 2, wherein the switching over means comprises a multi-way valve, the second pressure reducer being arranged between a safety valve and an outlet of the heat exchanger with respect to the flow direction.

5. The personal safety system in accordance with claim 1, wherein said pneumatic blower is in operative connection with said heat exchanger, said pneumatic blower comprising a pneumatic motor and a fan, said pneumatic pressure corresponding to a pressure that allows said pneumatic motor to actuate said pneumatic blower, said pneumatic operating pressure being different from said heat exchanger operating pressure.

6. The personal safety system in accordance with claim 1, wherein the cooling means includes a main line which is fed carbon dioxide from the carbon dioxide reservoir, wherein the first pressure reducer lowers a pressure prevailing in the main line, from a feed pressure of the carbon dioxide being fed, to said heat exchanger operating pressure for the heat exchanger and the second pressure reducer lowers the prevailing pressure further, in a connection with the heat exchanger, to said pneumatic pressure before the carbon dioxide is fed to the pneumatic blower, said first pressure reducer being in said main line, said second pressure reducer being located downstream of said first pressure reducer.

7. The personal safety system in accordance with claim 1, further comprising:

a carbon dioxide absorber comprising a connection pipe, a body and a basket, said body comprising a body opening, said basket being detachably inserted into the body for receiving loose soda lime, said basket comprising a basket interior space and an outer surface, said outer surface comprising a plurality of openings, said basket interior space being in communication with said body opening and an environment external to said basket via at least said plurality of openings, said connection pipe being connected to the body and the $CO_2$ cooling system, the $CO_2$ cooling system being located in the main room;

a sleeve, the connection pipe comprising a plurality of sealable inlets, wherein an amount of ambient air passing through the body, the basket and the connection pipe is controlled by sealing at least a portion of one or more of said sealable inlets with said sleeve.

8. A process for the operation of a personal safety system, the process comprising the steps of:

providing a personal safety system comprising a main room and a cooling means for cooling the ambient air of the main room, the cooling means comprising a carbon dioxide cooling system comprising a carbon dioxide reservoir, a heat exchanger, a first pressure reducer between the carbon dioxide reservoir and the heat exchanger and a second pressure reducer in connection with the heat exchanger;

feeding carbon dioxide from the carbon dioxide reservoir to a main line;

lowering a pressure prevailing in the main line, from a pressure of the carbon dioxide being fed, with the first pressure reducer to an operating pressure for the heat exchanger, the main line comprising a first main line portion located upstream of the first pressure reducer with respect to a flow of the carbon dioxide, the first main line portion extending between the carbon dioxide reservoir and the first pressure reducer, the main line comprising a second main line portion located downstream of the first pressure reducer with respect to the flow of the carbon dioxide, the second main line portion extending between the heat exchanger and the first pressure reducer, wherein the pressure of the carbon dioxide fed in the first main line portion is greater than the operating pressure for the heat exchanger in the second main line portion; and lowering a prevailing pressure further, in a connection with the heat exchanger, with the second pressure reducer to a pneumatic motor operating pressure before the carbon dioxide is fed to a pneumatic blower, wherein said second pressure reducer reduces said prevailing pressure in a flow direction from said heat exchanger to said pneumatic blower, wherein a conduit extends between the heat exchanger and the pneumatic blower, wherein a first conduit portion of the conduit extends from the heat exchanger to the second pressure reducer and a second conduit portion of the conduit extends from the second pressure reducer to the pneumatic blower, the first conduit portion being located upstream of the second pressure reducer with respect to the flow of the carbon dioxide, the second conduit portion being located downstream of the second pressure reducer with respect to the flow of the carbon dioxide, the carbon dioxide being delivered in the first conduit portion at the heat exchanger operating pressure, the carbon dioxide being delivered in the second conduit portion at the pneumatic motor operating pressure, the pneumatic motor operating pressure being less than the operating pressure for the heat exchanger and pressure of the carbon dioxide fed in the first main line portion.

9. The process in accordance with claim 8, wherein the heat exchanger comprises a plurality of cooling coils and the coils are alternatingly or cyclically switched over into and out of use, wherein the pressure of the carbon dioxide fed in the first main line portion is 200 bar, the operating pressure for the heat exchanger in the second main line portion being 10 bar, the pneumatic motor operating pressure being in a range from 2 bar to 6 bar, wherein a temperature of the carbon dioxide is increased from the first pressure reducer to the second pressure reducer exclusively via a heat exchange between the ambient air and the carbon dioxide.

10. The process in accordance with claim 8, wherein the pneumatic blower comprises a fan that distributes cooled ambient air from the heat exchanger into the main room of the refuge chamber, the second pressure reducer being arranged between a safety valve and an outlet of the heat exchanger with respect to the flow direction.

11. The process in accordance with claim 8, further comprising:

a carbon dioxide absorber for absorbing carbon dioxide out of the ambient air of the main room, the carbon dioxide absorber comprising a body and a basket detachably inserted into the body for receiving loose soda lime, said basket comprising a plurality of openings, said body comprising a body opening, said body opening being in fluid communication with said plurality of openings, wherein the carbon dioxide absorber further comprises a connection pipe with which the carbon dioxide absorber is connected or can be connected to the carbon dioxide cooling system, the carbon dioxide cooling system being located in the main room;

a sleeve, the connection pipe comprising a plurality of sealable inlets, wherein an amount of ambient air passing through the body, the basket and the connection pipe is controlled by sealing at least a portion of one or more of said sealable inlets with said sleeve.

12. A personal safety system in the form of a refuge chamber, the personal safety system comprising:

a main room;

a pneumatic blower; and a cooling system for cooling ambient air of the main room, the cooling system comprising a carbon dioxide cooling system comprising a carbon dioxide reservoir, a heat exchanger, a first pressure reducer between the carbon dioxide reservoir and the heat exchanger, a first conduit, a second conduit, and a third conduit and a second pressure reducer in connection with the heat exchanger, said first conduit extending between said carbon dioxide reservoir and said first pressure reducer, said first conduit being upstream of said first pressure reducer with respect to a flow of said carbon dioxide, said second conduit extending between said first pressure reducer and said second pressure reducer, said heat exchanger comprising at least a portion of said second conduit, said second conduit being downstream of said first pressure reducer and upstream of said second pressure reducer with respect to said flow of carbon dioxide, said third conduit extending between said second pressure reducer and said pneumatic blower, said third conduit being located downstream of said second pressure reducer with respect to said flow of carbon dioxide, said first pressure reducer receiving carbon dioxide from said first conduit at a first carbon dioxide pressure, wherein said first conduit defines a first zone of carbon dioxide provided between said carbon dioxide reservoir and said first pressure reducer, wherein the carbon dioxide exits said first pressure reducer into said second conduit at a second carbon dioxide pressure, said second carbon dioxide pressure being less than said first carbon dioxide pressure, said second conduit defining a second zone of carbon dioxide provided between the first pressure reducer and the second pressure reducer, wherein said carbon dioxide passes through said heat exchanger in said second zone of carbon dioxide, said second pressure reducer receiving the carbon dioxide from said second conduit at said second carbon dioxide pressure, wherein the carbon dioxide exits said second pressure reducer in said third conduit at a third carbon dioxide pressure, said third conduit defining a third zone of carbon dioxide provided between said second pressure reducer and said pneumatic motor, said second pressure reducer reducing said pressure in a flow direction from said heat exchanger to said pneumatic blower, said third carbon dioxide pressure being less than said first carbon dioxide pressure and said second carbon dioxide pressure.

13. The personal safety system in accordance with claim 12, wherein the heat exchanger receives the carbon dioxide at the second carbon dioxide pressure, said second carbon dioxide pressure corresponding to a heat exchanger operating pressure for operating said heat exchanger, said first carbon dioxide pressure being 200, said second carbon dioxide pressure being 10 bar, said third carbon dioxide pressure being in a range from 2 bar to 6 bar, wherein a temperature of said carbon dioxide increases from said first pressure reducer to said second pressure reducer exclusively via said ambient air.

14. The personal safety system in accordance with claim 13, wherein the pneumatic blower is located downstream of the heat exchanger, said pneumatic blower comprising a pneumatic blower motor, said third carbon dioxide pressure corresponding to a pneumatic pressure for operating said pneumatic motor.

15. The personal safety system in accordance with claim 14, wherein said pneumatic blower is in operative connection with the heat exchanger.

16. The personal safety system in accordance with claim 15, wherein said first pressure reducer is arranged between said first zone of carbon dioxide and said second zone of carbon dioxide, said second pressure reducer being arranged between said second zone of carbon dioxide and said third zone of carbon dioxide.

17. The personal safety system in accordance with claim 12, further comprising:

a carbon dioxide absorber for absorbing carbon dioxide out of the ambient air of the main room, the carbon dioxide absorber comprising a body and a basket detachably inserted into the body for receiving loose soda lime, said basket comprising a plurality of openings, said body comprising a body opening, said body opening being in fluid communication with said plurality of openings, wherein the carbon dioxide absorber further comprises a connection pipe with which the carbon dioxide absorber is connected or can be connected to the carbon dioxide cooling system, the carbon dioxide cooling system being arranged in the main room;

a sleeve, the connection pipe comprising a plurality of sealable inlets, wherein an amount of ambient air passing through the body, the basket and the connection pipe is controlled by sealing at least a portion of one or more of said sealable inlets with said sleeve.

18. The personal safety system in accordance with claim 12, wherein the heat exchanger comprises a plurality of cooling coils, the cooling coils being alternatingly or cyclically operated cooling coils.

19. The personal safety system in accordance with claim 18, wherein the cooling system further comprises switching over means for switching over between the cooling coils in order to make possible a thawing of a respective unused cooling coil.

20. The personal safety system in accordance with claim 18, wherein the switching over means comprises a multiway valve, the second pressure reducer being arranged between a safety valve and an outlet of the heat exchanger with respect to the flow direction.

* * * * *